US006010836A

United States Patent [19]

Eichorst et al.

[11] Patent Number: 6,010,836

[45] Date of Patent: Jan. 4, 2000

[54] IMAGING ELEMENT COMPRISING AN ELECTRICALLY-CONDUCTIVE LAYER CONTAINING INTERCALATED VANADIUM OXIDE AND A TRANSPARENT MAGNETIC RECORDING LAYER

[75] Inventors: Dennis J. Eichorst, Fairport; Sylvia A. Gardner; Gustav R. Apai, II, both of Rochester, all of N.Y.; Long K. Duong, Centreville, Va.

[73] Assignee: Eastman Kodak Company, Rochester, N.Y.

[21] Appl. No.: 09/162,182

[22] Filed: Sep. 28, 1998

[51] Int. Cl.[7] ..... G03C 1/89

[52] U.S. Cl. ..... 430/530; 430/527

[58] Field of Search ..... 430/527, 530

[56] References Cited

U.S. PATENT DOCUMENTS

| | | |
|---|---|---|
| 4,203,769 | 5/1980 | Guestauz . |
| 5,006,451 | 4/1991 | Anderson et al. . |
| 5,073,360 | 12/1991 | Kairy et al. . |
| 5,203,884 | 4/1993 | Buchanan et al. . |
| 5,221,598 | 6/1993 | Anderson et al. . |
| 5,284,714 | 2/1994 | Anderson et al. . |
| 5,356,468 | 10/1994 | Havens et al. . |
| 5,360,706 | 11/1994 | Anderson et al. . |
| 5,366,544 | 11/1994 | Jones et al. . |
| 5,366,855 | 11/1994 | Anderson et al. . |
| 5,380,584 | 1/1995 | Anderson et al. . |
| 5,427,835 | 6/1995 | Morrison et al. . |
| 5,432,050 | 7/1995 | James et al. . |
| 5,439,785 | 8/1995 | Boston et al. . |
| 5,455,153 | 10/1995 | Gardner . |
| 5,514,528 | 5/1996 | Chen et al. . |
| 5,576,163 | 11/1996 | Anderson et al. . |
| 5,637,368 | 6/1997 | Cadalbert et al. . |
| 5,659,034 | 8/1997 | DeBord et al. . |
| 5,709,984 | 1/1998 | Chen et al. . |
| 5,718,995 | 2/1998 | Eichorst et al. . |

OTHER PUBLICATIONS

Mater. Res. Soc. Symp. Proc. vol. 233, pp. 183–194, 1991.
Chem. Mater. vol. 8, pp. 1992–2004, 1996.
Chem. Mater. vol. 3, pp 992–994, 1991.
Chem. Mater. vol. 8, pp. 525–534, 1996.
Adv. Mater., vol. 5, No. 5, pp. 369–372, 1993.

*Primary Examiner*—Richard L. Schilling
*Attorney, Agent, or Firm*—Andrew J. Anderson

[57] ABSTRACT

In accordance with one embodiment of the invention, an imaging element is disclosed comprising: (i) a support; (ii) at least one image forming layer; (iii) a transparent magnetic recording layer comprising magnetic particles dispersed in a first film-forming binder; and (iv) an electrically-conductive layer comprising colloidal vanadium oxide intercalated with a water soluble vinyl-containing polymer dispersed in a second film-forming binder. The water soluble vinyl-containing polymer is preferably poly-N-vinylpyrrolidone, polyvinyl alcohol or an interpolymer thereof. Intercalation of colloidal vanadium oxide with water soluble vinyl-containing polymers results in improved stability of coating formulations, and an improved colloidal vanadium oxide which is compatible with a wider selection of polymeric binders and facilitates higher binder:vanadium oxide ratios which can improve adhesion of a transparent magnetic layer.

23 Claims, No Drawings

IMAGING ELEMENT COMPRISING AN ELECTRICALLY-CONDUCTIVE LAYER CONTAINING INTERCALATED VANADIUM OXIDE AND A TRANSPARENT MAGNETIC RECORDING LAYER

CROSS REFERENCE TO RELATED APPLICATIONS

Reference is made to concurrently filed, commonly assigned, copending U.S. Ser. No. 09/162,174 (Kodak Docket No. 78429), entitled "Imaging Element Comprising an Electrically-Conductive Layer Containing Intercalated Vanadium Oxide", and U.S. Ser. No. 09/161,881 (Kodak Docket No. 78431), entitled "Colloidal Vanadium Oxide Having Improved Stability", the disclosures of which are incorporated by reference in their entireties.

FIELD OF THE INVENTION

This invention relates generally to imaging elements and in particular, to imaging elements comprising a support, one or more image-forming layers, a transparent magnetic recording layer, and one or more transparent, electrically-conductive layers. More specifically, this invention relates to photographic and thermally-processable imaging elements having one or more sensitized silver halide emulsion layers and a transparent magnetic recording layer in combination with one or more electrically-conductive layers containing colloidal vanadium oxide intercalated with a water-soluble vinyl-containing polymer.

BACKGROUND OF THE INVENTION

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 4,990,276; 5,215,874; 5,217,804; 5,229,259; 5,252,441; 5,254,449; 5,335,589; 5,395,743; 5,413,900; 5,427,900; 5,498,512; 5,709,984 and others. Such elements are advantageous because images can be recorded by customary photographic processes while information can be recorded simultaneously into or read from the magnetic recording layer by techniques similar to those employed for traditional magnetic recording art.

The transparent magnetic recording layer must be capable of accurate recording and playback of digitally encoded information repeatedly on demand by various devices such as a camera or a photofinishing or printing system. The magnetic layer also must exhibit excellent running, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic layers. These goals are particularly difficult to achieve when magnetically recorded information is stored and read from the photographic image area. Further, because of the curl of the photographic element the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the generation and discharge of electrostatic charge during the manufacture and use of photographic film and paper have been recognized for many years by the photographic industry. The accumulation of charge on film surfaces leads to the attraction of dust, which can produce physical defects. The discharge of accumulated charge during or after application of the sensitized emulsion layers can produce irregular fog patterns or static marks in the emulsion. The severity of the static problems has been exacerbated greatly by increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during transport through the coating machines, and during post-coating operations such as slitting, perforating, and spooling. Static charge can also be generated during the use of the finished photographic product. In an automatic camera, because of the repeated motion of the photographic film in and out of the film cassette, there is the added problem of the generation of electrostatic charge by movement of the film across the magnetic heads and by repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance. This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from electrostatic charging, there are various well known methods by which an electrically-conductive or antistatic layer can be introduced into the photographic element to dissipate any accumulated electrostatic charge.

The use of such electrically-conductive layers containing suitable semi-conductive metal oxide particles dispersed in a film-forming binder in combination with a transparent magnetic recording layer in silver halide imaging elements has been described in the following examples of the prior art. Photographic elements comprising a transparent magnetic recording layer and a transparent electrically-conductive layer both located on the backside of the film base have been described in U.S. Pat. Nos. 5,147,768; 5,229,259; 5,294,525; 5,336,589; 5,382,494; 5,413,900; 5,457,013; 5,459,021; and others. The conductive layers described in these patents contain fine granular particles of a semi-conductive crystalline metal oxide such as zinc oxide, titania, tin oxide, alumina, indium oxide, silica, complex or compound oxides thereof, and zinc antimonate or indium antimonate dispersed in a polymeric film-forming binder.

Antistatic backing or subbing layers containing colloidal "amorphous" vanadium pentoxide, especially silver-doped vanadium pentoxide, as described in U.S. Pat. Nos. 4,203,769 and 5,439,785, are highly effective at providing static protection, have excellent transparency and are not significantly dependent on humidity. Colloidal vanadium pentoxide is composed of entangled microscopic fibrils or ribbons 0.005–0.01 μm wide, about 0.001 μm thick, and 0.1–1 μm in length. However, colloidal vanadium pentoxide is soluble at the high pH typical of developer solutions for photographic processing and must be protected by a nonpermeable barrier layer. Examples of suitable barrier layers are taught in U.S. Pat. Nos. 5,006,451; 5,221,598; 5,284,714; and 5,366,855, for example. Further, when a conductive layer containing colloidal vanadium pentoxide underlies a transparent magnetic layer, the magnetic layer inherently can serve as a nonpermeable barrier layer. However, if the magnetic layer contains a high level of reinforcing filler particles, such as γ-aluminum oxide or silica fine particles, it must be crosslinked using suitable cross-linking agents in order to preserve the desired barrier properties, as taught in U.S. Pat. No. 5,432,050.

Alternatively, a film-forming sulfopolyester latex or polyesterionomer binder can be combined with the colloidal vanadium pentoxide in the conductive layer to minimize degradation during wet processing as taught in U.S. Pat. Nos. 5,360,706; 5,380,584; 5,427,835; 5,576,163; and others. Furthermore, it is disclosed that the use of a polyesterionomer can improve solution stability of colloidal vanadium pentoxide containing dispersions. Instability of vanadium pentoxide gels in the presence of various binders is well known and several specific classes of polymeric binders have been identified for improved stability or coatability, for example in U.S. Pat. Nos. 5,427,835; 5,439,785; 5,360,706; and 5,709,984. U.S. Pat. No. 5,427,835 teaches the use of sulfopolymers in combinations with vanadium oxide preferably prepared from hydrolysis of oxoalkoxides for antistatic applications. A specific advantage cited for preparation of vanadium oxide gels from oxoalkoxides is the ability to control the vanadium oxidation state. Colloidal vanadium oxide gels are described as viscous dark brown solutions which become homogeneous upon aging. Comparative Example 3 describes the formation of "dark greenish clots" upon mixing with polyacrylic acid indicating a change in oxidation state and flocculation of the gel. Similarly, the examples of sulfopolymers with vanadium oxide result in a color change from dark brown to dark greenish-brown, again indicating a potentially undesirable change in vanadium oxidation state.

U.S. Pat. No. 5,439,785 teaches the use of a specified ratio of sulfopolymer to vanadium oxide to provide an antistatic formulation which remains conductive after photographic processing. A range of from 1:20 to 1:150 $V_2O_5$:sulfopolymer is specified. Surface electrical resistivity values are typically greater than $1\times10^9$ ohm/square for the indicated range. At lower colloidal vanadium oxide concentrations, the conductivity is insufficient to provide antistatic protection; at higher vanadium oxide concentrations the antistatic layer loses conductivity when subjected to photographic processing. However, prior art colloidal vanadium pentoxide typically have significantly lower resistivity values, i.e., $1\times10^8$ ohm/square. Consequently, one of the primary benefits of colloidal vanadium oxide, low resistivity at low dry weight coverage is not achieved.

Colloidal vanadium oxide dispersed with a terpolymer of vinylidene chloride, acrylonitrile, and acrylic acid coated on subbed polyester supports and overcoated with a transparent magnetic recording layer is taught in U.S. Pat. Nos. 5,432,050 and 5,514,528. U.S. Pat. No. 5,514,528 also teaches an antistatic layer consisting of colloidal vanadium oxide and an aqueous dispersible polyester coated on a subbed polyester support and subsequently overcoated with a transparent magnetic recording layer.

U.S. Pat. No. 5,718,995 teaches an antistatic layer containing colloidal vanadium oxide and a specified polyurethane binder having excellent adhesion to surface treated polyester supports and an overlying transparent magnetic layer. However, it is further disclosed that the coating composition has limited shelf-life (less then 48 hrs.). In order to overcome the limited shelf life, a mixed melt process was preferably used in which separate solutions of colloidal vanadium pentoxide and of the polyurethane binder were prepared and mixed in-line just prior to the coating hopper. This results in an undesirable complication of the coating process. It is further disclosed in '995 that it is difficult to achieve adequate adhesion to glow discharge treated polyethylene naphthalate for a magnetics backing package consisting of a solvent coated cellulosic-based magnetic layer overlying an antistatic layer containing colloidal vanadium pentoxide and the preferred sulfopolyesters or interpolymers of vinylidene chloride cited in the above mentioned U.S. patents.

In addition to the aqueous-based coating compositions described above it may be advantageous to coat antistatic layers from solvent-based formulations. U.S. Pat. No. 5,709,984 describes antistatic layers containing colloidal vanadium oxide gel, a volatile aromatic compound, and a polymeric binder prepared from a solvent-based dispersion using acetone and ethanol. Polymeric binders demonstrated include interpolymers of vinylidene chloride, polymethylmethacrylate, cellulose nitrate and cellulose diacetate. It is further disclosed that due to the exceptional adhesion requirements of antistatic layers containing colloidal vanadium oxide, such layers generally exhibit poor adhesion when directly coated on untreated or unsubbed supports, especially when overcoated with a transparent magnetic recording layer. Furthermore, it is particularly difficult to achieve adequate adhesion for a cellulosic-based transparent magnetic recording layer, especially when the polymeric binder/vanadium oxide gel ratio is less than 1/1.

U.S. Pat. No. 5,455,153 describes photographic elements containing a clad vanadium pentoxide layer. The cladding layer is formed by applying an overcoat of an oxidatively polymerizable compound which may be applied neat to the vanadium oxide or in the form of an aqueous solution, a solvent solution or as a vapor. Suitable oxidatively polymerizable monomers include anilines, pyrroles, thiophenes, furans, selenophenes and tellurophenes. Antistatic layers containing clad vanadium oxide were demonstrated to have improved resistance to basic solutions as typically encountered during conventional photographic processing. Improved base resistance results from cladding the surface of vanadium pentoxide rather than a change resulting from polymer intercalation between vanadium oxide layers.

Intercalation of various species, including cations, metal-containing complexes, organic molecules and polymers, within the vanadium oxide gel structure is well-known, particularly in the catalysis field and as cathode materials for batteries. However, intercalated colloidal vanadium oxide for antistatic applications has not typically been addressed.

U.S. Pat. No. 5,659,034 describes intercalation of metal coordination complexes, particularly $Zn(2,2\mathbf{40}\text{-dipyridyl})_2$, between layers of vanadium oxide. The resultant intercalated vanadium oxide was described as black rod-shaped crystals which are unsuitable for antistatic applications for photographic films.

U.S. Pat. No. 5,073,360 describes the formation of bridged/lamellar metallic oxides having intercalated spheroidal cationic species. The preferred metallic oxide is vanadium pentoxide and the spheroidal cationic species is preferably an aluminum polyoxocation, particularly $[Al_{13}O_4(OH)_{24}]_7^+$. The vanadium oxide gel can be prepared for example by ion exchange or melt quenching. The intercalated material is then isolated by filtration, dried and optionally calcined to give high surface area materials which are particularly suited as molecular sieve filters, catalysts, and catalyst supports. However, no indication is given regarding the antistatic properties of the intercalated vanadium oxide.

Intercalation of a wide variety of organic or polymeric materials between vanadium oxide layers in vanadium oxide gels is well known. Intercalative polymerization of aniline resulting in polyaniline is described in Mater. Res. Soc. Symp. Proc. V. 233, pp. 183–194, 1991 and Chem. Mater. V. 8, pp. 1992–2004, 1996. A significant decrease in oxygen concentration and a color change from red to dark blue was observed when vanadium oxide gel was added to an air saturated solution of aniline in water. Conductivity of the polyaniline-vanadium oxide material increased substantially upon aging. It was proposed that conductivity in the fresh material occurred by electron transport through the vanadium oxide framework (semiconductive) but upon aging a metallic-like conductivity dominated as polyaniline chains formed.

Poly(ethylene oxide) intercalated vanadium oxide gels were reported in Chem. Mater, Vol. 3, 992–994, 1991 and Chem. Mater, Vol. 8, 525–534, 1996 to be highly light sensitive, turning dark blue within several weeks for exposure to room light or within several hours for exposure to UV irradiation. Non-intercalated vanadium oxide gels were not light sensitive. In addition to a color change, the conductivity increased and solubility decreased with increasing irradiation. However, the irradiated conductivity decreased with increasing polyethylene oxide intercalation. Changes in the vanadium oxide interlayer distance due to intercalation of poly(vinylpyrrolidone) (PVP), poly(propylene-glycol) (PPG), and methylcellulose are described in Adv. Mater, Vol. 5, 369–372, 1993. Interlayer distance increased linearly for $(PVP)_xV_2O_5.nH_2O$ for values of x up to 3. Furthermore, a change in the chemical nature of PVP was noted and ascribed to formation of hydrogen bonding with co-intercalated water. The interlayer spacing did not vary linearly with either PPG or methylcellulose. The interlayer distance remained constant for $(PPG)_xV_2O_5.nH_2O$ with x values greater than 1, and PPG remained chemically unaltered. Particularly in the case of PPG, the samples were light sensitive as indicated above.

The above references indicate a vast array of organic or polymeric species can be intercalated within vanadium oxide gel structures. However, the intercalated material is frequently light sensitive and conductivity changes during aging. Furthermore, intercalation and subsequent reaction frequently decreases solubility of the vanadium oxide gel. Consequently, it would be neither anticipated nor expected that intercalation of vanadium oxide gels with water-soluble polymeric species would result in a vanadium oxide gel having improved solution stability and reduced impact of solution aging on conductivity.

The use of polyvinylpyrrolidone in antistatic formulations is also well known. For example, U.S. Pat. Nos. 4,418,141; 4,495,276; 5,368,995; 5,484,694; 5,453,350; 5,514,528 and others include polyvinylpyrrolidone amongst an extensive list of suitable binders for antistatic materials such as tin oxide or zinc antimonate. There is no specific mention or claim to enhanced properties or stability of polyvinylpyrrolidone or other water soluble vinyl-containing polymers relative to other polymeric binders for the above mentioned patents.

U.S. Pat. No. 4,489,152 describes a diffusion transfer film having an opaque layer consisting of carbon black having 2–10 percent polyvinylpyrrolidone based on the weight of carbon black. The addition of polyvinylpyrrolidone having a molecular weight of about 10,000 to the carbon black layer was found to improve the silver transfer process. However, there was no indication of antistatic properties nor of improved formulation stability for the carbon black layer.

U.S. Pat. No. 4,860,754 describes an electrically conductive adhesive material consisting of a low molecular weight plasticizer, a high molecular weight water soluble, crosslinkable polymer, uncrosslinked polyvinylpyrrolidone, and an electrolyte. The uncrosslinked polyvinylpyrrolidone is added as a tackifier. Antistatic properties of the adhesive material are insufficient for photographic applications since the electrolyte can be removed during wet photographic processing. Furthermore, ionic conductors are generally not effective when overcoated with a hydrophobic layer such as a typical transparent magnetic recording layer.

U.S. Pat. No. 5,637,368 describes the use of colloidal dispersions of vanadium oxide for imparting antistatic properties to adhesive tapes. Polyvinylpyrrolidone and polyvinylpyrrolidone copolymers are included in a list of suitable adhesive compounds. The use of vanadium oxide in the adhesive layer is suggested, but all examples consist of a separate vanadium oxide layer and a separate adhesive layer. In addition polyvinylpyrrolidone was neither demonstrated nor disclosed to give superior performance. Furthermore, use of the adhesive material having antistatic properties for use in photographic imaging applications is not suggested.

As disclosed in the above mentioned U.S. patents several polymers, for example interpolymers of vinylidene chloride, sulfopolyesters, polyesterionomers, and cellulosics have been used as binders for antistatic layers containing colloidal vanadium oxide. However, due to the solution chemistry and oxidative potential of vanadium oxide, the selection of compatible binders or a suitable vanadium oxide to binder formulation range is limited. For example, for low coating coverages vanadium pentoxide may typically be coated at 0.05 weight percent or less. Such low concentrations result in coating formulations which are prone to instability and flocculation of the vanadium oxide gel. This creates serious difficulties in accumulation of flocculated vanadium oxide plugging solution delivery lines, filters and coating hoppers. Furthermore, flocculation can result in coating defects or "slugs" which can result in optical and electrical non-uniformities in the coating. The addition of surfactants to the coating solution may stabilize the vanadium oxide gel, however, the typically high levels of surfactant required are undesirable for adhesion and coatability of subsequently applied layers, particularly magnetic recording layers. The concern of stability has been addressed in many of the above U.S. patents. Furthermore, interaction between colloidal vanadium oxide and polymeric binders can result in limited dispersion shelf-life. In addition to the potential for incompatibility of binders, it is well known that vanadium pentoxide can act as a reactant or catalyst for decomposition of organic solvents. Decomposition products can degrade the coating quality of the antistatic layer or subsequently coated layers and can adversely impact the sensitometric performance of photographic emulsions thereby requiring careful selection of coating solvents and binders for the antistatic layer or overlying layers. The indicated problems with regards to solution stability, incompatibility and potential interactions for an antistatic layer containing colloidal vanadium oxide limits the selection of possible polymeric binders which may be desired for certain physical performance requirements such as adhesion or abrasion resistance.

Because the requirements for an electrically-conductive layer to be useful in an imaging element are extremely demanding, the art has long sought to develop improved conductive layers exhibiting a balance of the necessary chemical, physical, optical, and electrical properties. As indicated hereinabove, the prior art for providing electrically-conductive layers useful for imaging elements is extensive and a wide variety of suitable electroconductive materials have been disclosed. However, there is still a critical need in the art for improved conductive layers which can be used in a wide variety of imaging elements, which can be manufactured at a reasonable cost, which are resistant to the effects of humidity change, which are durable and abrasion-resistant, which do not exhibit adverse sensitometric or photographic effects, which exhibit acceptable adhesion to overlying or underlying layers, which exhibit suitable cohesion, which have improved solution stability, which have improved binder compatibility, and which have low catalytic or reactant activity. Further, to provide both effective magnetic recording properties and effective electrical-conductivity characteristics in an imaging element, without impairing its imaging characteristics, poses a considerably greater technical challenge.

In particular, an improved colloidal vanadium oxide which is compatible with a wider selection of polymeric binders or facilitates the use of higher binder:vanadium oxide ratios to improve adhesion to the support and underlying or overlying layers is desired. It is toward the objective of providing a useful combination of a transparent magnetic recording layer and electrically-conductive layers containing colloidal vanadium oxide that more effectively meet the diverse needs of imaging elements, especially those of silver halide photographic films, but also of a wide variety of other types of imaging elements than those of the prior art that the present invention is directed.

SUMMARY OF THE INVENTION

In accordance with one embodiment of the invention, an imaging element is disclosed comprising: (i) a support; (ii) at least one image forming layer; (iii) a transparent magnetic recording layer comprising magnetic particles dispersed in a first film-forming binder; and (iv) an electrically-conductive layer comprising colloidal vanadium oxide intercalated with a water soluble vinyl-containing polymer dispersed in a second film-forming binder. The water soluble vinyl-containing polymer is preferably poly-N-vinylpyrrolidone, polyvinyl alcohol or an interpolymer thereof. It was neither expected nor anticipated that intercalation of colloidal vanadium oxide with water soluble vinyl-containing polymers would result in improved stability of coating formulations. Furthermore, it was unanticipated that intercalation would result in an improved colloidal vanadium oxide which is compatible with a wider selection of polymeric binders or facilitate higher binder:vanadium oxide ratios which can improve adhesion of a transparent magnetic layer.

DETAILED DESCRIPTION OF THE INVENTION

The present invention provides an imaging element for use in an image-forming process including a support, at least one image-forming layer, a transparent magnetic recording layer, and at least one electrically-conductive layer, wherein, the electrically-conductive layer contains a film forming polymeric binder and colloidal vanadium oxide which is intercalated with a water soluble vinyl-containing polymer. A particular advantage of intercalated vanadium oxide of the present invention is improved compatibility with a wider selection of polymeric binders or a wider range of binder to colloidal vanadium oxide than is achievable with prior art colloidal vanadium oxide. An increase in polymeric binder to vanadium oxide can improve adhesion of an overlying transparent magnetic layer, particularly a cellulosic-based magnetic layer. In addition, a wider selection of compatible binders is desired to adequately satisfy the physical, chemical and electrical requirements of an imaging element containing an antistatic layer and a transparent magnetic layer. Furthermore, the improved solution stability of the present invention is desirable for improved manufacturability.

Imaging elements including a transparent magnetic recording layer are described, for example, in U.S. Pat. Nos. 3,782,947; 4,279,945; 4,302,523; 4,990,276; 5,215,874; 5,217,804; 5,252,441; 5,254,449; 5,335,589; 5,395,743; 5,413,900; 5,427,900 and others; in European Patent Application No. 0 459,349 and in Research Disclosure, Item No. 34390 (November, 1992). Such elements are advantageous because they can be employed to record images by the customary photographic process while at the same time additional information can be recorded on and read from the magnetic layer by techniques similar to those employed in the magnetic recording art. A transparent magnetic layer can be positioned in an imaging element in any of a variety of positions. For example, it can overlie one or more image-forming layers, underlie one or more image-forming layers, be interposed between image-forming layers, serve as a subbing layer for an image-forming layer, be coated on the side of the support opposite an image-forming layer or can be incorporated into an image-forming layer.

Conductive layers in accordance with this invention are broadly applicable to photographic, thermographic, electrothermographic, photothermographic, dielectric recording, dye migration, laser dye-ablation, thermal dye transfer, electrostatographic, electrophotographic imaging elements, and others. Details with respect to the composition and function of this wide variety of imaging elements are provided in U.S. Pat. Nos. 5,719,016 and 5,731,119. Conductive layers of the present invention may be present, e.g., as a subbing layer underlying a sensitized silver halide emulsion layer(s); a subbing layer underlying a transparent magnetic recording layer; an intermediate layer either overlying or underlying a pelloid in a multi-element curl control layer, in particular, a backing layer on the side of the support opposite to the emulsion layer(s). When the antistatic layer underlies an emulsion layer, pelloid layer or other hydrophilic layer it is preferred to overcoat the antistatic layer with a nonpermeable barrier layer for use in a photographic imaging element. When the imaging element is for use in a dry process such as thermographic or electrothermographic, the antistatic layer may also be present as an outermost layer overlying either an imaging or emulsion layer, as an outermost layer overlying a transparent magnetic layer, or as an intermediate layer inserted between emulsion layers without the addition of a nonpermeable barrier layer. In accordance with preferred embodiments of the invention, the conductive layer comprising intercalated vanadium oxide underlies the magnetic recording layer. Conductive layers of this invention are strongly adherent to the support and other underlying layers as well as to overlying layers such as pelloid, abrasion-resistant, transport control, magnetic recording or imaging layers. Further, the electrical conductivity afforded by conductive layers of this invention is nearly independent of relative humidity and only slightly degraded when overcoated with a transparent magnetic recording layer or barrier.

Colloidal vanadium oxide is commonly referred to as an "amorphous" gel which is composed of highly entangled microscopic fibrils, fibers or ribbons 0.005–0.01 $\mu$m wide, about 0.001 $\mu$m thick, and 0.1–1 $\mu$m in length. Colloidal vanadium oxide can be prepared by any variety of methods, including but not specifically limited to melt quenching as described in U.S. Pat. No. 4,203,769, ion exchange as described in DE 4,125,758, hydrolysis of a vanadium oxoalkoxide as claimed in U.S. Pat. No. 5,407,603, hydrolysis or thermohydrolysis of $VOCl_3$ or $VO_2OAc$, reaction of vanadium or vanadium oxide with hydrogen peroxide or nitric acid, and direct hydrolysis of amorphous or fine-grained vanadium oxide. Melt-quenched vanadium oxide can be prepared by melting vanadium pentoxide or a mixture of vanadium oxide and optional additives, dopants or modifiers generally 100° C. to 500° C. above the melting point and quenching the molten mixture into water. The quenched material is typically aged to form a colloidal gel. Other methods of preparing quenched vanadium oxide include laser melting and splat cooling, for example, Rivoalen describes supercooling a melt on a roll cooled to the temperature of liquid nitrogen in J. Non-Crystalline Solids, 21, 171 (1976). Colloidal vanadium gels can be prepared by hydrolysis with a molar excess of deionized water of vanadium oxoalkoxides, preferably a trialkoxide of the formula $VO(OR)_3$ wherein each R is independently an aliphatic, aryl, heterocyclic or arylalkyl group. Preferably, hydrolysis occurs in the presence of a hydroperoxide such as hydrogen peroxide or t-butyl hydrogen peroxide. Ion exchange of soluble vanadium containing species, such as sodium metavanadate or ammonium metavanadate can be used to prepare colloidal vanadium pentoxide gels. In this process, protons are exchanged for the sodium or ammonium ions resulting in a hydrated gel. Preferred methods of preparing colloidal vanadium pentoxide are the melt-quench technique, detailed in U.S. Pat. No. 4,203,769, and hydrolysis of vanadium alkoxide or oxoalkoxides as taught in U.S. Pat. No. 5,407,603, both incorporated herein by reference with respect to the preparation of such colloidal vanadium oxides.

Conductivity of vanadium oxide coatings may be enhanced by controlling the colloidal vanadium oxide morphology and vanadium oxidation state. One method of controlling the morphology and oxidation state is by addition of a dopant or modifier. Another method of controlling the vanadium oxidation state is the use of both $V^{4+}$ and $V^{5+}$ containing species, for example during hydrolysis of vanadium oxoalkoxides. In addition to modifying conductivity or morphology, the presence of a metal dopant or modifier can alter the color or dispersability. Suitable dopants or modifiers may include vanadium (4+), lithium, sodium, potassium, magnesium, calcium, manganese, copper, zinc, germanium, niobium, molybdenum, silver, tin, antimony, tungsten, bismuth, neodymium, europium, gadolinium, and ytterbium. Preferred metal dopants are calcium, magnesium, molybdenum, tungsten, zinc and silver. The dopant or modifiers may be added in any form suitable for the selected synthetic method. For example, metal oxides, metal phosphates, or metal polyphosphates may be mixed with vanadium pentoxide and melt quenched; metal alkoxides or metal oxoalkoxides may be added to a solution of vanadium oxoalkoxide and hydrolyzed, or a mixture of metal salts with ammonium vanadate or sodium metavanadate may be used for an ion exchange processes. Typically, when present, dopants or modifiers are added at the 0.1–20 mole percent level. An additional method of increasing the conductivity and adhesion of colloidal vanadium oxide coatings is the addition of conductivity-increasing amount of a volatile aromatic compound comprising an aromatic ring substituted with at least one hydroxy group or a hydroxy substituted substituent group as disclosed in U.S. Pat. No. 5,709,984 and incorporated herein by reference with regards to volatile aromatic compounds.

Water-soluble vinyl-containing polymers suitable for intercalation of the vanadium oxide gel include: poly-N-vinylpyrrolidone, polyvinylpyrrolidone interpolymers such as polyvinylpyrrolidone-polyvinylacetate, polyvinyl alcohol, polyvinyl alcohol interpolymers such as polyvinyl alcohol-ethylene, polyvinyl methyl ether and the like. Molecular weight of the vinyl-containing polymers may preferably range from about 10,000 to 400,000. Intercalation may be achieved by simply adding a dispersion of a vanadium oxide gel to an aqueous solution of the water soluble polymer. The amount of water soluble vinyl-containing polymer added is such an amount that causes intercalation, but less than that resulting in loss of the fibrous nature of colloidal vanadium oxide. Intercalation is demonstrated by insertion of the polymer between the layers of the colloidal vanadium oxide gel resulting in an increase in basal spacing of the layer by at least 1 Å. Suitable amounts of intercalated polymer can vary depending on the specific water soluble vinyl-containing polymer, the presence of dopant or modifier species, the concentration of colloidal vanadium oxide and the desired conductivity level. However, it is generally preferred to use a molar ratio (based upon monomer units) of intercalating polymer to colloidal vanadium oxide of from 1:4 to 20:1. More preferably, molar ratios of at least 1:2, and most preferably at least 1:1 are used for optimal intercalation. A more preferred upper limit ratio of intercalating polymer to colloidal vanadium oxide is about 5:1, as above such ratio additional polymer may not effectively intercalate. In accordance with specific preferred embodiments of the invention, weight ratios of intercalating polyvinylpyrrolidone polymer to colloidal vanadium oxide of from about 1:2 to 4:1 are used.

In accordance with preferred embodiments of the invention, the use of vanadium oxide gels intercalated with water soluble vinyl-containing polymers allows for the selection of diverse, distinct film-forming binders in electrically-conductive layers, including binders which may not effectively be used with non-intercalated vanadium oxides.

Polymeric film-forming binders useful in conductive layers of the present invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes, aqueous dispersions of sulfonated polyurethanes, polyesterionomers, and aqueous-dispersable sulfonated polyesters. Additional suitable binders are disclosed in U.S. Pat. Nos. 5,356,468 and 5,366,544, incorporated herein by reference. Gelatin derivatives, aqueous dispersed polyurethanes, sulfonated polyurethanes, polyesterionomers, aqueous emulsions of vinylidene halide copolymers, vinyl acetate interpolymers, methacrylates and cellulosics are preferred binders for conductive layers of this invention. Preferred vinylidene halide based polymers include terpolymers of vinylidene chloride/methyl acrylate/itaconic acid and vinylidene chloride/acrylonitrile/acrylic acid. Preferred methacrylates include polymethylmethacrylate and butylmethacrylate-containing polymers. Preferred cellulosics include cellulose acetate, cellulose triacetate, and cellulose nitrate. Preferred vinyl acetate interpolymers are vinyl acetate-ethylene emulsions. Preferred polyurethane binders are aliphatic, anionic polyurethanes which have an ultimate elongation to break of at least 350 percent, such as Witcobond W-236 commercially available from Witco Corporation, and aliphatic, anionic, polyurethanes which have a tensile elongation to break of at least 50% and a Young's modulus measured at 2% elongation of at least 50,000 $lb/in^2$, such as Witcobond W-232.

The ratio of conductive vanadium oxide to polymeric film-forming binder in a conductive layer is one of the critical factors which influences the ultimate conductivity of that layer. If this ratio is too small, little or no antistatic property is exhibited. If the ratio is too large, adhesion between the conductive layer and the support or overlying layers can be diminished. The optimum ratio of conductive material to binder can vary depending on the colloidal vanadium oxide conductivity, vanadium oxide morphology, binder type, total dry weight coverage or coating thickness, and the conductivity requirements for the imaging element. The dry weight ratio of colloidal vanadium pentoxide to polymeric film-forming binder is preferably from 4:1 to 1:500, and more preferably from 2:1 to 1:250. While relatively high polymer binder to vanadium oxide weight ratios of greater than 4:1 and even greater than 8:1 may be desirable for many applications to provide good adhesion to underlying and overlying layers, dispersions of vanadium oxide gels are not stable with many polymeric binders at such high binder ratios, in particular many polyurethane polymeric binders. In accordance with a preferred embodiment of the invention, stabilized intercalated vanadium oxide gels allow for the use of such binders at relatively high levels in electrically conductive layers.

Solvents useful for preparing dispersions and coating formulations containing intercalated colloidal vanadium oxide and a polymeric binder include water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone or a combination thereof.

In addition to intercalated colloidal vanadium pentoxide and one or more suitable film-forming polymeric binders, other components that are well known in the photographic art also can be included in conductive layers of this invention. Other addenda, such as matting agents, surfactants or coating aids, polymer lattices to improve dimensional stability, thickeners or viscosity modifiers, charge control agents, hardeners or cross-linking agents, soluble antistatic agents, soluble and/or solid particle dyes, magnetic particles, antifoggants, lubricating agents, and various other conventional additives optionally can be present in any or all of the layers of the multilayer imaging element.

Dispersions containing intercalated colloidal vanadium pentoxide, a polymeric film-forming binder, and various additives in a suitable liquid vehicle can be applied to film or paper supports using any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, as well as other coating methods known in the art.

Dispersions of intercalated colloidal vanadium oxide in suitable liquid vehicles can be formulated with a polymeric film-forming binder and various addenda and applied to a variety of supports to form electrically-conductive layers of this invention. Typical photographic film supports include: cellulose nitrate, cellulose acetate, cellulose acetate butyrate, cellulose acetate propionate, poly(vinyl acetal), poly (carbonate), poly(styrene), poly(ethylene terephthalate), poly(ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Film supports can be surface-treated by various processes including corona discharge, glow discharge, UV exposure, flame treatment, electron-beam treatment, as described in U.S. Pat. No. 5,718,995; treatment with adhesion-promoting agents including dichloro- and trichloroacetic acid, phenol derivatives such as resorcinol, 4-chloro-3-methyl phenol, and p-chloro-m-cresol; and solvent washing or can be overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly (ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m), e.g., are suitable for photographic elements in accordance with this invention.

The electrically-conductive layer of this invention can be applied to the support at any suitable coverage depending on the specific requirements of a particular type of imaging element. For example, for silver halide photographic films, total dry weight coverages for conductive layers containing vanadium pentoxide are preferably in the range of from about 0.002 to 1.5 g/m$^2$ with the higher coverages generally preferred at higher binder/vanadium oxide ratios. More preferred dry coverages are in the range of about 0.005 to 0.5 g/m$^2$. The conductive layers of this invention typically exhibit a surface electrical resistivity (SER) value of less than $1\times10^{10}$ ohms/square, preferably less than $1\times10^{9}$ ohms/square, and more preferably less than $1\times10^{8}$ ohms/square. When overcoated with a transparent magnetic recording layer, abrasion resistant protective layer or a barrier layer, the conductive layers of this invention typically exhibit internal electrical resistivity (wet electrode resistivity) values of less than $1\times10^{11}$ ohms/square, preferably less than $1\times10^{10}$ ohms/square, and more preferably less than $1\times10^{9}$ ohms/square.

Imaging elements having a transparent magnetic recording layer are well known in the imaging art as described hereinabove. Such a transparent magnetic recording layer contains a polymeric film-forming binder, ferromagnetic particles, and other optional addenda for improved manufacturability or performance such as dispersants, coating aids, fluorinated surfactants, crosslinking agents or hardeners, catalysts, lubricants, abrasive particles, filler particles, and the like.

Suitable ferromagnetic particles include ferromagnetic iron oxides, such as: $\gamma$-$Fe_2O_3$, $Fe_3O_4$; $\gamma$-$Fe_2O_3$ or $Fe_3O_4$ bulk-doped or surface-treated with Co, Zn, Ni or other metals; ferromagnetic chromium dioxides such as $CrO_2$ or $CrO_2$ doped with Li, Na, Sn, Pb, Fe, Co, Ni, Zn or halogen atoms in solid solution; ferromagnetic transition metal ferrites; ferromagnetic hexagonal ferrites, such as barium and strontium ferrite; and ferromagnetic metal alloys with oxide coatings on their surface to improve chemical stability and/or dispersibility. In addition, ferromagnetic oxides with a shell of a lower refractive index particulate inorganic material or a polymeric material with a lower optical scattering cross-section as taught in U.S. Pat. Nos. 5,217,804 and 5,252,444 can be used. Suitable ferromagnetic particles exhibit a variety of sizes, shapes and aspect ratios. The preferred ferromagnetic particles for magnetic recording layers used in combination with the conductive layers of this invention are cobalt surface-treated γ-iron oxide with a specific surface area greater than 30 $m^2/g$.

As taught in U.S. Pat. No. 3,782,947, whether an element is useful for both photographic and magnetic recording depends on the size distribution and concentration of the ferromagnetic particles as well as the relationship between the granularities of the magnetic and the photographic layers. Generally, the coarser the grain of the silver halide emulsion in the photographic element containing a magnetic recording layer, the larger the mean size of the magnetic particles which are suitable. A magnetic particle coverage of from about 10 to 1000 $mg/m^2$, when uniformly distributed across the imaging area of a photographic imaging element, provides a magnetic recording layer that is suitably transparent to be useful for photographic imaging applications for particles with a maximum dimension of less than about 1 μm. Magnetic particle coverages less than about 10 $mg/m^2$ tend to be insufficient for magnetic recording purposes. Magnetic particle coverages greater than about 1000 $mg/m^2$ tend to produce magnetic recording layers with optical densities too high for photographic imaging. Particularly useful particle coverages are in the range of 20 to 70 $mg/m^2$. Coverages of about 20 $mg/m^2$ are particularly useful in magnetic recording layers for reversal films and coverages of about 40 $mg/m^2$ are particularly useful in magnetic recording layers for negative films. Magnetic particle concentrations of from about $1\times10^{-11}$ to $1\times10^{-10}$ $mg/\mu m^3$ are preferred for transparent magnetic recording layers prepared for use in accordance with this invention.

Suitable polymeric binders for use in the magnetic layer include, for example: vinyl chloride-based copolymers such as, vinyl chloride-vinyl acetate copolymers, vinyl chloride-vinyl acetate-vinyl alcohol terpolymers, vinyl chloride-vinyl acetate-maleic acid terpolymers, vinyl chloride-vinylidene chloride copolymers, vinyl chloride-acrylonitrile copolymers; acrylic ester-acrylonitrile copolymers, acrylic ester-vinylidene chloride copolymers, methacrylic ester-vinylidene chloride copolymers, methacrylic ester-styrene copolymers, thermoplastic polyurethane resins, phenoxy resins, polyvinyl fluoride, vinylidene chloride-acrylonitrile copolymers, butadiene-acrylonitrile copolymers, acrylonitrile-butadiene-acrylic acid terpolymers, acrylonitrile-butadiene-methacrylic acid terpolymers, polyvinyl butyral, polyvinyl acetal, cellulose derivatives such as cellulose esters including cellulose acetate, cellulose diacetate, cellulose triacetate, cellulose acetate butyrate, cellulose acetate proprionate; styrene-butadiene copolymers, polyester resins, phenolic resins, thermosetting polyurethane resins, melamine resins, alkyl resins, urea-formaldehyde resins and the like. Preferred binders for organic solvent-coated transparent magnetic layers are polyurethanes, vinyl chloride-based copolymers, and cellulose esters, particularly cellulose diacetate and cellulose triacetate.

Binders for transparent magnetic recording layers also can be film-forming hydrophilic polymers such as water soluble polymers, cellulose ethers, latex polymers and water-dispersible polyesters as described in *Research Disclosures* No. 17643 and 18716 and U.S. Pat. Nos. 5,147,768; 5,457,012; 5,520,954, and 5,531,913. Suitable water-soluble polymers include gelatin, gelatin derivatives, casein, agar, starch, polyvinyl alcohol, acrylic acid copolymers, and maleic acid anhydride. Suitable cellulose ethers include carboxymethyl cellulose and hydroxyethyl cellulose. Other suitable aqueous binders include aqueous lattices of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl chloride copolymers and vinylidene chloride copolymers, and butadiene copolymers and aqueous dispersions of polyurethanes or polyesterionomers. Preferred hydrophilic binders include gelatin, gelatin derivatives, and combinations of gelatin with a polymeric cobinder. Preferred gelatins include any alkali- or acid-treated gelatins.

The binder in the magnetic recording layer can be optionally crosslinked by any of a variety of methods known in the art. Binders which contain active hydrogen atoms including —OH, —$NH_2$, —NHR, where R is an organic radical, and the like, can be crosslinked using an isocyanate or polyisocyanate as described in U.S. Pat. No. 3,479,310. Suitable polyisocyanates include: tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, and polymers thereof; polyisocyanates prepared by reacting an excess of an organic diisocyanate with an active hydrogen-containing compounds such as polyols, polyethers and polyesters and the like, including ethylene glycol, propylene glycol, dipropylene glycol, butylene glycol, trimethylol propane, hexanetriol, glycerine sorbitol, pentaerythritol, castor oil, ethylenediamine, hexamethylenediamine, ethanolamine, diethanolamine, triethanolamine, water, ammonia, urea, and the like, including biuret compounds, allophanate compounds, and the like. One preferred polyisocyanate crosslinking agent is the reaction product of trimethylol propane and 2,4-tolylene diisocyanate sold by Mobay under the tradename Mondur CB 75.

Further, hydrophilic binders can be hardened using any of a variety of methods known to one skilled in the art. Useful hardening agents include aldehyde compounds such as formaldehyde, ketone compounds, isocyanates, aziridine compounds, epoxy compounds, chrome alum, zirconium sulfate, and the like.

Examples of suitable solvents for coating the magnetic recording layer include: water; ketones, such as acetone, methyl ethyl ketone, methylisobutyl ketone, and cyclohexanone; alcohols, such as methanol, ethanol, isopropanol, and butanol; esters such as ethyl acetate and butyl acetate; ethers; aromatic solvents, such as toluene; and chlorinated hydrocarbons, such as carbon tetrachloride, chloroform, dichloromethane; trichloromethane, trichloroethane; tetrahydrofuran; glycol ethers such as ethylene glycol monomethyl ether, and propylene glycol monomethyl ether; and ketoesters, such as methylacetoacetate. Optionally, due to the requirements of binder solubility, magnetic dispersability and coating rheology, a mixture of solvents may be advantageous. One preferred solvent mixture for cellulosic-based magnetic layers consists of a chlorinated hydrocarbon, ketone and/or alcohol, and ketoesters. Another preferred solvent mixture consists of a chlorinated hydrocarbon, ketone and/or alcohols, and a glycol ether. Other preferred solvent mixtures include dichloromethane, acetone and/or methanol, methylacetoacetate; dichloromethane, acetone and/or methanol, propylene glycol monomethyl ether; and methylethyl ketone, cyclohexanone and/or toluene. For hydrophilic binders and water-soluble binders, such as gelatin, water is the preferred solvent.

The transparent magnetic layer can be positioned in an imaging element in any of various positions. For example, it can overlie one or more image-forming layers, or underlie one or more image forming layers, or be interposed between image-forming layers, or serve as a subbing layer for an image-forming layer, or be coated on the side of the support opposite to an image-forming layer. In a silver halide photographic element, the transparent magnetic layer is preferably on the side of the support opposite the silver halide emulsion. A typical thickness for the magnetic layer is in the range from about 0.05 to 10 $\mu$m.

Conductive layers of this invention can be incorporated into multilayer imaging elements in any of various configurations depending upon the requirements of the specific imaging element. The conductive layer of this invention is located preferably on the same side of the support as the magnetic layer as a subbing or tie layer underlying the magnetic layer. Conductive layers also may be located on the same side of the support as the imaging layer(s) or on both sides of the support. A conductive subbing layer can be applied either under or over a gelatin subbing layer containing an antihalation dye or pigment. Alternatively, both antihalation and antistatic functions can be combined in a single layer containing conductive vanadium pentoxide, antihalation dye, and a binder. This hybrid layer is typically coated on the same side of the support as the sensitized emulsion layer. Additional optional layers can be present as well. Further, an additional optional conductive layer can be used as an outermost layer of an imaging element, for example, as a protective layer overlying an image-forming layer for photographic imaging elements.

In a particularly preferred embodiment, imaging elements of this invention are photographic elements which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially Examples 16 and 21, are particularly suitable. Any of the known silver halide emulsion layers, such as those described in *Research Disclosure*, Vol. 176, Item 17643 (December, 1978), *Research Disclosure*, Vol. 225, Item 22534 (January, 1983), *Research Disclosure*, Item 36544 (September, 1994), and *Research Disclosure*, Item 37038 (February, 1995) and the references cited therein are useful in preparing photographic elements in accordance with this invention. Generally, the photographic element is prepared by coating the film support on the side opposite the transparent magnetic recording layer with one or more layers containing a silver halide emulsion and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Imaging elements incorporating conductive layers in combination with transparent magnetic recording layers in accordance with this invention also can comprise additional layers including adhesion-promoting layers, lubricant or transport-controlling layers, hydrophobic barrier layers, antihalation layers, abrasion and scratch protection layers, and other special function layers. Imaging elements of this invention incorporating conductive layers containing colloidal vanadium oxide intercalated with a water soluble vinyl-containing polymer in combination with transparent magnetic recording layers, useful for specific imaging applications such as color negative films, color reversal films, black-and-white films, color and black-and-white papers, electrographic media, dielectric recording media, thermally processable imaging elements, thermal dye transfer recording media, laser ablation media, ink jet media and other imaging applications should be readily apparent to those skilled in photographic and other imaging arts.

The method of the present invention is illustrated by the following detailed examples of its practice. However, the scope of this invention is by no means restricted to these illustrative examples.

Samples A–D

Colloidal vanadium oxide gels were prepared by a melt-quench method as described in U.S. Pat. No. 4,203,769. Vanadium pentoxide was melted in a furnace, quenched into distilled water and aged for 3 months to form a uniform reddish-brown colloidal gel. The resulting vanadium oxide gel was diluted with distilled water to 0.285 weight percent $V_2O_5$ for Sample A. The vanadium oxide gel was added to solutions in water of polyvinylpyrrolidone (PVP) having an average molecular weight of 37,900 to give the corresponding total weight percentages of $V_2O_5$ and PVP indicated in Table 1 for Samples B–D.

Samples E–H

Colloidal vanadium oxide gels were prepared by a melt-quench method as described in U.S. Pat. No. 4,203,769. Mixtures of silver oxide (up to 10 mole percent) and vanadium pentoxide were melted in a furnace, quenched into distilled water and aged for 3 months to form a uniform reddish-brown colloidal gel. The resulting silver-doped vanadium oxide gels were diluted with distilled water to 0.285 weight percent $V_2O_5$ for Sample E or added to solutions of PVP in water to give the corresponding total weight percentages of $V_2O_5$ and PVP indicated in Table 1 for Samples F–H.

Samples I and J

Colloidal vanadium oxide gels were prepared by an ion exchange method. 300 ml of a 0.35 M solution of sodium metavanadate in distilled water was poured through a column of 100 grams Dowex 50X2-100 resin which had been previously washed with 1.2 M HCl. The solution was aged for 3 months to form a uniform reddish-brown colloidal gel (2.8 weight percent solids). The resulting vanadium oxide gels were either diluted with distilled water to 0.285 weight percent vanadium pentoxide (Sample I) or added to a solution of PVP in distilled water to give a solution containing 0.285 weight percent vanadium pentoxide and 0.14 weight percent PVP (Sample J).

Samples K AND L

Colloidal vanadium oxide gels were prepared by hydrolysis of vanadium oxoalkoxide as taught in U.S. Pat. No. 5,407,603. 15.8 g of vanadium oxoisobutoxide was added to a stirred solution of 1.56 g of 30 percent hydrogen peroxide in 233 ml of water. The resulting dark brown gel was stirred at room temperature for 3 hours, poured into a glass jar and aged for 3 months at room temperature to yield a 2.2 weight percent reddish-brown gel. The resulting vanadium oxide gel was either diluted with distilled water to 0.285 weight percent vanadium pentoxide (Sample K) or added to a solution of PVP in distilled water to a give a solution containing 0.285 weight percent vanadium pentoxide and 0.14 weight percent PVP (Sample L).

Samples M AND N

Calcium-doped colloidal vanadium oxide gels were prepared by a melt-quench method similar to Samples E and F. A mixture of calcium oxide (up to 3 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample M) or added to a solution of PVP in distilled water to give a solution containing 0.285 weight percent vanadium pentoxide and 0.14 weight percent PVP (Sample N).

Samples O AND P

Doped colloidal vanadium oxide gels were prepared by a melt-quench method similar to Samples E and F. A mixture of silver oxide (up to 8 mole percent), lithium fluoride (up to 1 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample O) or added to a solution of PVP in distilled water to a give a solution containing 0.285 weight percent vanadium pentoxide and 0.14 weight percent PVP (Sample P).

Samples Q AND R

Zinc-doped colloidal vanadium oxide gels were prepared by a melt-quench technique similar to Samples E and F. A mixture of zinc oxide (up to 3 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample Q) or added to a solution of PVP in distilled water to give a solution containing 0.285 weight percent vanadium pentoxide and 0.14 weight percent PVP (Sample R).

Samples S AND T

Doped colloidal vanadium oxide gels were prepared by a melt-quench method similar to Samples E and F. A mixture of silicon dioxide (up to 4 mole percent), silver oxide (up to 8 mole percent) and vanadium pentoxide was melted in a furnace, quenched into distilled water and aged for 3 months to form a uniform reddish-brown colloidal gel. The resulting vanadium oxide gel was either diluted with distilled water to 0.285 weight percent vanadium pentoxide (Sample S) or added to a solution of PVP in distilled water to give a solution containing 0.285 weight percent vanadium pentoxide and 0.14 weight percent PVP (Sample T).

TABLE 1

Description of Vanadium Oxide Gels.

| Sample | Type | wt % $V_2O_5$ | wt % PVP | Dopant species | Synthetic Method |
|---|---|---|---|---|---|
| Sample A | Comp. | 0.285 | — | undoped | melt-quench |
| Sample B | Inv. | 0.285 | 0 14 | undoped | melt-quench |
| Sample C | Inv. | 0.285 | 0.28 | undoped | melt-quench |
| Sample D | Inv. | 0.285 | 0.70 | undoped | melt-quench |
| Sample E | Comp. | 0.285 | — | Ag | melt-quench |
| Sample F | Inv. | 0.285 | 0.14 | Ag | melt-quench |
| Sample G | Inv. | 0.285 | 0.28 | Ag | melt-quench |
| Sample H | Inv. | 0.285 | 0.70 | Ag | melt-quench |
| Sample I | Comp. | 0.285 | — | undoped | ion exchange |
| Sample J | Inv. | 0.285 | 0.14 | undoped | ion exchange |
| Sample K | Comp. | 0.285 | — | undoped | oxoalkoxide |
| Sample L | Inv. | 0.285 | 0.14 | undoped | oxoalkoxide |
| Sample M | Comp. | 0.285 | — | Ca | melt-quench |
| Sample N | Inv. | 0.285 | 0.14 | Ca | melt-quench |
| Sample O | Comp. | 0.285 | — | AgO/LiF | melt-quench |
| Sample P | Inv. | 0.285 | 0.14 | AgO/LiF | melt-quench |

TABLE 1-continued

Description of Vanadium Oxide Gels.

| Sample | Type | wt % $V_2O_5$ | wt % PVP | Dopant species | Synthetic Method |
|---|---|---|---|---|---|
| Sample Q | Comp. | 0.285 | — | Zn | melt-quench |
| Sample R | Inv. | 0.285 | 0.14 | Zn | melt-quench |
| Sample S | Comp. | 0.285 | — | Si/Ag | melt-quench |
| Sample T | Inv. | 0.285 | 0.14 | Si/Ag | melt-quench |

EXAMPLES 1–8

Colloidal vanadium oxide gel samples A–H (0.285 weight percent) were spin-coated at 2000 rpm on glass microscope slides and allowed to air dry. The d-spacing (001) corresponding to the basal distance between vanadium layers in the coating was determined by X-ray diffraction using Cu $K_\alpha$ radiation. Table 2 gives d-spacing values for Examples 1–8. The increase in d-spacing of the undoped or doped vanadium oxide gel with increasing polyvinylpyrrolidone amount indicates intercalation of the polymer resulting in a modified vanadium oxide gel structure. Though by no means a requirement of the invention, it is believed that preferential association of vinyl-containing polymers with catalytically active or reactive sites consequently reduces chemical reactivity or hinders other compounds from reacting with the vanadium oxide, thereby resulting in the improved solution stability and thermal stability described below.

TABLE 2

XRD Results

| Sample | Vanadium oxide gel sample | wt % PVP | d-spacing (Å) |
|---|---|---|---|
| Example 1 | Sample A | 0 | 12.8 |
| Example 2 | Sample B | 0.14 | 20.7 |
| Example 3 | Sample C | 0.28 | 26.0 |
| Example 4 | Sample D | 0.70 | 40.6 |
| Example 5 | Sample E | 0 | 12.4 |
| Example 6 | Sample F | 0.14 | 23.6 |
| Example 7 | Sample G | 0.28 | 29.0 |
| Example 8 | Sample H | 0.70 | 38.0 |

EXAMPLE 9 AND COMPARATIVE EXAMPLE 9

Vanadium pentoxide gel samples G and E were mixed with a para(t-octyl)phenoxy poly(ethoxy) ethanol surfactant commercially available from Rohm & Haas under the tradename Triton X-100 at a nominal ratio of 1/1 for Example 9 and Comparative Example 9, respectively. Nominally 3.6 mg of the sample containing vanadium pentoxide and surfactant was placed in a 20 ml septum capped headspace vial. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 $\mu$m thick film capillary column. The gas chromatograph oven was preheld at 40° C. for four minutes and then heated to 250° C. at 15° C./min. The mass scan range was from 21 to 250 atomic mass units with a 3 minute solvent delay. In addition, vanadium pentoxide gel samples E and G without a surfactant were evaluated. Reaction products and retention times for the samples are given in Table 3.

EXAMPLE 10 AND COMPARATIVE EXAMPLE 10

Vanadium pentoxide gel samples G and E were mixed with a paraisononylphenoxy polyglycidol surfactant commercially available from Olin Mathieson Corporation under the tradename Surfactant 10G at a nominal ratio of 1/1 for Example 10 and Comparative Example 10, respectively. Nominally 3.6 mg of the sample containing vanadium pentoxide and surfactant was placed in a 20 ml septum capped headspace vial. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 μm thick film capillary column. The gas chromatograph oven was preheld at 40° C. for four minutes and then heated to 250° C. at 15° C./min. The mass scan range was from 21 to 250 atomic mass units with a 3 minute solvent delay. In addition, vanadium pentoxide gel samples E and G without a surfactant were evaluated. Reaction products and retention times for the samples are given in Table 3.

TABLE 3

GC Mass spectrometry results with surfactants (units are in mass spectrometer detector area counts)

| species | Sample E | Sample G | Ex. 9 | Comp. Ex. 9 | Ex. 10 | Comp. Ex. 10 |
|---|---|---|---|---|---|---|
| Formic acid | 0 | 0 | 13.5 | 309.7 | 5.9 | 14.2 |
| 1,2-Ethanediol Monoformate | 0 | 0 | 0 | 12.4 | 0 | 0 |
| 1,2-Ethanediol diformate | 0 | 0 | 0 | 123.1 | 0 | 0 |
| 2-Methoxy-1,3-Dioxalane | 0 | 0 | 0 | 115.1 | 0 | 8.5 |

EXAMPLE 11 AND COMPARATIVE EXAMPLE 11

Vanadium oxide gel samples E and F were spin coated on silicon wafers. One microliter of acetone was added to the vanadium oxide coatings from samples E and F for Comparative Example 11 and Example 11, respectively. The coated silicon wafers were placed in 22 ml headspace vials and equilibrated for 3 hrs at 125° C. The headspace above the samples was analyzed using a Perkin-Elmer HS-40 Headspace analyzer. The gas chromatagraph oven was held for 3 minutes at 40° C., then heated to 230° C. at 12° C./min and held for 5 minutes at 230° C. The mass scan range was from 21 to 550 atomic mass units. Gas chromatography results for the samples and for acetone similarly applied to a silicon wafer without a vanadium oxide coating are given in Table 4.

TABLE 4

GC Mass spectrometry results with acetone. (units are in mass spectrometer detector area counts)

| species | retention time (min.) | acetone onto Si wafer | Comp. Ex. 11 | Example 11 |
|---|---|---|---|---|
| Acetone | 4.8 | 1239 | 1209 | 1281 |
| Acetic Acid | 14.5 | 0 | 58.3 | 12.8 |
| Formic Acid | 15.3 | 0 | 36.4 | 4.4 |

EXAMPLE 12 AND COMPARATIVE EXAMPLE 12

Nominally equal amounts of vanadium pentoxide gel Samples E and G were placed in 22 ml headspace vials and one microliter of acetone was injected into the vials containing Samples E and G for Comparative Example 12 and Example 12, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 μm thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of acetone and for acetone without the presence of vanadium oxide gel. Reaction products and retention times for the samples are given in Table 5.

TABLE 5

GC Mass spectrometry results with acetone. (units are in mass spectrometer detector area counts)

| species | retention time (min) | Sample E | Sample G | Acetone | Comp. Ex. 12 | Ex. 12 |
|---|---|---|---|---|---|---|
| Acetone | 4.6 | 0 | 0 | 3333 | 3121.7 | 3325.8 |
| Acetic acid | 14.5 | 0 | 0 | 0 | 182.0 | 8.6 |
| Formic acid | 15.27 | 0 | 0 | 0 | 114.2 | 0 |

EXAMPLE 13 AND COMPARATIVE EXAMPLE 13

Nominally equal amounts of vanadium pentoxide gel Samples E and G were placed in 22 ml headspace vials and one microliter of methanol was then injected into the vials containing Samples E and G for Comparative Example 13 and Example 13, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 μm thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of methanol and for methanol without the presence of vanadium oxide gel. Reaction products and retention times for the samples are given in Table 6.

TABLE 6

GC Mass spectrometry results with methanol.
(units are in mass spectrometer detector area counts)

| species | retention time (min) | Sample E E | Sample G G | Methanol | Comp. Ex. 13 | Ex. 13 |
|---|---|---|---|---|---|---|
| Dimethoxy methane | 3.5 | 0 | 0 | 0 | 218.1 | 118.2 |
| Methyl formate | 3.8 | 0 | 0 | 0 | 588.4 | 50.6 |
| Methanol | 5.9 | 0 | 0 | 2425 | 874.1 | 2414.2 |
| Acetic acid | 14.5 | 0 | 0 | 0 | 0 | 93.0 |
| Formic Acid | 15.27 | 0 | 0 | 0 | 48.4 | 0 |

EXAMPLE 14 AND COMPARATIVE EXAMPLE 14

Nominally equal amounts of vanadium pentoxide gel Samples E and G were placed in 22 ml headspace vials and one microliter of n-butanol was injected into the vials containing Samples E and G for Comparative Example 14 and Example 14, respectively. The samples were equilibrated at 100° C. for two hours. The headspace above the sample was analyzed by Headspace GC mass spectrometry using a Perkin-Elmer HS-40 Headspace analyzer. Separation was achieved with a 30M, Restek Rtx-50, 0.25 mm ID, 1 $\mu$m thick film capillary column. The gas chromatograph oven was preheld at 40° C. for four minutes and then heated to 230° C. at 12° C./min and held at 230° C. for 5 minutes. The mass scan range was from 21 to 550 atomic mass units. GC analysis was also obtained for Samples E and G without the addition of n-butanol and for n-butanol without the presence of vanadium oxide gel. Reaction products and retention times for the samples are given in Table 7.

TABLE 7

GC Mass spectrometry results with butanol.
(units are in mass spectrometer detector area counts)

| species | retention time | Sample E | Sample G | n-butanol | Comp. Ex. 14 | Ex. 14 |
|---|---|---|---|---|---|---|
| Acetaldehyde | 3.23 | 0 | 0 | 0 | 43.5 | 0 |
| Propanal | 4.26 | 0 | 0 | 0 | 298.6 | 62.45 |
| Butanal | 5.63 | 0 | 0 | 0 | 2900.65 | 1416.35 |
| Butyl Formate | 8.23 | 0 | 0 | 0 | 1157.4 | 129.85 |
| Butanal | 8.73 | 0 | 0 | 0 | 63.35 | 15.65 |
| Butyl Acetate | 9.11 | 0 | 0 | 0 | 135.15 | 14.5 |
| Butanol | 10.21 | 0 | 0 | 4485 | 2604.55 | 3914.4 |
| Acetic Acid | 14.5 | 0 | 0 | 0 | 67.8 | 11.53 |
| Formic Acid | 15.29 | 0 | 0 | 0 | 102.3 | 9.85 |
| Propanoic Acid | 15.5 | 0 | 0 | 0 | 128.6 | 15.85 |
| Butanoic Acid | 16.5 | 0 | 0 | 0 | 77.4 | 6 |

The above results for Examples 9–14 clearly indicate intercalated vanadium oxide gels have greatly reduced reactivity with common coating solvents or surfactants than prior art colloidal vanadium oxide (Comparative Examples 9–14). In particular, there are fewer species detected after reaction with intercalated vanadium oxide gels than after reaction with non-intercalated vanadium oxide. Furthermore, for the identified species from reaction with intercalated vanadium oxide, there is typically a reduced level present when compared with non-intercalated vanadium oxide. The reduced catalytic or chemical activity resulting for intercalated vanadium oxide is of particular interest for photographic imaging elements which may be fogged by the evolution of unanticipated chemical species from a coated layer and for applications in which reaction with common solvents can result in a corrosive environment due to the formation of various organic acids.

EXAMPLE 15

Vanadium oxide gel sample F intercalated with polyvinylpyrrolidone was placed in a prewetted Spectra/Por molecular porous membrane dialysis tube having a molecular weight cutoff of 12,000–14,000 and a dry thickness of 0.9 mil (23 microns). The tube ends were tied and the filled dialysis tube placed in a 4000 ml beaker of continuously replenished distilled water and allowed to dialyze for one week. The resulting vanadium oxide gel sample had a uniform dark reddish-brown coloration with no observable change in appearance.

A coating solution consisting of 0.0285 weight percent dialyzed vanadium pentoxide gel, 0.0285 weight percent terpolymer latex binder and 0.02 weight percent Triton X-100 (Rohm & Haas) was coated on a 4 mil (100 $\mu$m) thick polyethylene terephthalate support using a coating rod to give a 3 mil (76 $\mu$m) wet coverage and a nominal dry coverage of 0.022 g/m$^2$. The terpolymer latex consisted of acrylonitrile, vinylidene chloride, and acrylic acid. The support had been coated previously with a typical primer layer consisting of acrylonitrile, vinylidene chloride, and acrylic acid. The surface electrical resistivity (SER) of the conductive layer was measured at nominally 20° C. and 50% relative humidity using a two-point DC electrode method similar to that described in U.S. Pat. No. 2,801,191. For adequate antistatic performance, conductive layers with SER values of 10 log ohms/square or less are preferred. The SER value for the vanadium oxide gel coating was 8.3 log ohms/sq. indicating excellent antistatic properties for the dialyzed vanadium oxide gel.

COMPARATIVE EXAMPLE 15

Vanadium oxide gel sample E was placed in a prewetted Spectra/Por molecular porous membrane dialysis tube having a molecular weight cutoff of 12,000–14,000 and a dry thickness of 0.9 mil (23 microns). The tube ends were tied and the filled dialysis tube placed in a 4000 ml beaker of continuously replenished distilled water and dialyzed for one week. The resulting vanadium oxide gel sample had a light orange brown appearance with green-brown fibular debris rather than a uniform dark reddish-brown coloration indicating considerable degradation of the gel structure.

A coating solution consisting of 0.0285 weight percent dialyzed vanadium oxide gel, 0.0285 weight percent terpolymer latex binder and 0.020 weight percent Triton X-100 was coated on 4 mil (100 $\mu$m) thick polyethylene terephthalate support using a coating rod to give a 3 mil (76 $\mu$m) wet coverage and a nominal dry coverage of 0.022 g/m$^2$. The terpolymer latex consisted of acrylonitrile, vinylidene chloride, and acrylic acid. The support had been coated previously with a typical primer layer consisting of acrylonitrile, vinylidene chloride, and acrylic acid. The SER value for the vanadium oxide gel coating was greater than 12 log ohms/sq. which is not considered effective for antistatic applications.

EXAMPLES 16–23 AND COMPARATIVE EXAMPLES 16–23

Solutions of vanadium oxide gel samples A–T were diluted with distilled water to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m$^2$. The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 8.

EXAMPLES 24–31 AND COMPARATIVE EXAMPLES 24–31

Solutions of vanadium oxide gel samples A–T were diluted with ethanol to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m$^2$. The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 9.

EXAMPLES 32–39 AND COMPARATIVE EXAMPLES 32–39

Solutions of vanadium oxide gel samples A–T were diluted with a 50:50 mixture of ethanol and acetone to 0.0285 weight percent vanadium pentoxide. The solutions had 0.020 weight percent of Triton X-100 added as a coating aid. The solutions were coated on 4 mil (100 $\mu$m) thick polyethylene terephthalate supports using a coating rod to give a 3 mil (76 $\mu$m) wet coverage and a nominal dry coverage of 0.022 g/m$^2$. The support had been coated previously with a typical primer layer consisting of a terpolymer latex of acrylonitrile, vinylidene chloride, and acrylic acid. Coatings were prepared using fresh solutions or aged solutions. The coatings were dried at 100° C. for 1 minute. SER values for vanadium oxide gel layers are given in Table 10.

TABLE 8

Surface electrical resistivity (log ohms/sq) of vanadium oxide gel coatings from aqueous solutions

| | | SER log ohms/sq. | | | |
|---|---|---|---|---|---|
| Sample | $V_2O_5$ oxide gel sample | Fresh soln | aged soln (2 weeks) | aged soln (10 weeks) | aged soln (6 months) |
| Example 16 | Sample B | 9.3 | 9.2 | 9.4 | ** |
| Example 17 | Sample F | 7.7 | 7.7 | ** | 8.5 |
| Example 18 | Sample J | 8.5 | 8.7 | 9.0 | ** |
| Example 19 | Sample L | 8.5 | 8.2 | 9.0 | ** |
| Example 20 | Sample N | 8.3 | 8.6 | 9.1 | ** |
| Example 21 | Sample P | 7.6 | 7.9 | 8.5 | ** |
| Example 22 | Sample R | 7.7 | 7.9 | 8.5 | ** |
| Example 23 | Sample T | 9.3 | 9.5 | 9.7 | ** |
| Comp. Ex 16 | Sample A | 9.1 | 9.3 | 11.9 | ** |
| Comp. Ex 17 | Sample E | 7.4 | 8.0 | ** | >12 |
| Comp. Ex 18 | Sample I | 8.6 | 9.0 | >12 | ** |
| Comp. Ex 19 | Sample K | 8.4 | 8.9 | >12 | ** |
| Comp. Ex 20 | Sample M | 8.1 | 8.5 | >12 | ** |
| Comp. Ex 21 | Sample O | 7.7 | 7.8 | >12 | ** |
| Comp. Ex 22 | Sample Q | 7.9 | 7.8 | >12 | ** |
| Comp. Ex 23 | Sample S | 9.4 | 9.9 | >12 | ** |

TABLE 9

Surface electrical resistivity (log ohms/sq) of vanadium oxide gel coatings from ethanolic solutions.

| | | SER log ohms/sq for coatings | | | |
|---|---|---|---|---|---|
| Sample | $V_2O_5$ oxide gel sample | Fresh soln | aged soln (2 weeks) | aged soln (10 weeks) | aged soln (6 months) |
| Example 24 | Sample B | 9.1 | 9.3 | 9.5 | ** |
| Example 25 | Sample F | 7.6 | 7.9 | ** | 8.1 |
| Example 26 | Sample J | 8.4 | 8.8 | 9.1 | ** |
| Example 27 | Sample L | 8.3 | 8.9 | 9.1 | ** |
| Example 28 | Sample N | 8.2 | 8.5 | 9.0 | ** |
| Example 29 | Sample P | 7.9 | 8.5 | 8.8 | ** |
| Example 30 | Sample R | 8.0 | 8.4 | 8.6 | ** |
| Example 31 | Sample T | 9.1 | 9.0 | 9.6 | ** |
| Comp. Ex 24 | Sample A | 9.3 | 9.2 | >12 | ** |
| Comp. Ex 25 | Sample E | 6.7 | 9.2 | ** | >12 |
| Comp. Ex 26 | Sample I | 8.7 | 9.3 | >12 | ** |
| Comp. Ex 27 | Sample K | 8.5 | 9.2 | >12 | ** |
| Comp. Ex 28 | Sample M | 8.0 | 8.7 | >12 | ** |
| Comp. Ex 29 | Sample O | 8.0 | 7.9 | >12 | ** |
| Comp. Ex 30 | Sample Q | 8.2 | 8.1 | >12 | ** |
| Comp. Ex 31 | Sample S | 9.6 | 9.8 | >12 | ** |

TABLE 10

Surface electrical resistivity (log ohms/sq) of vanadium oxide gel coatings prepared from acetone/ethanol mixtures.

| | | SER log ohms/sq. for coatings | | | |
|---|---|---|---|---|---|
| Sample | $V_2O_5$ oxide gel sample | Fresh soln | aged soln (2 weeks) | aged soln (10 weeks) | aged soln (6 months) |
| Example 32 | Sample B | 9.1 | 9.4 | 9.3 | ** |
| Example 33 | Sample F | 8.3 | 8.3 | ** | 8.4 |
| Example 34 | Sample J | 8.3 | 8.7 | 9.0 | ** |
| Example 35 | Sample L | 8.4 | 8.5 | 9.0 | ** |
| Example 36 | Sample N | 8.1 | 8.7 | 9.1 | ** |
| Example 37 | Sample P | 8.1 | 7.9 | 9.0 | ** |
| Example 38 | Sample R | 8.1 | 8.0 | 8.7 | ** |
| Example 39 | Sample T | 9.2 | 9.5 | 9.8 | ** |
| Comp. Ex 32 | Sample A | 9.0 | 9.4 | >12 | ** |
| Comp. Ex 33 | Sample E | 7.8 | 8.2 | ** | >12 |
| Comp. Ex 34 | Sample I | 8.7 | 9.4 | >12 | ** |
| Comp. Ex 35 | Sample K | 8.6 | 9.1 | >12 | ** |

TABLE 10-continued

Surface electrical resistivity (log ohms/sq) of vanadium oxide gel coatings prepared from acetone/ethanol mixtures.

| Sample | $V_2O_5$ oxide gel sample | SER log ohms/sq. for coatings: Fresh soln | aged soln (2 weeks) | aged soln (10 weeks) | aged soln (6 months) |
|---|---|---|---|---|---|
| Comp. Ex 36 | Sample M | 8.2 | 8.5 | >12 | ** |
| Comp. Ex 37 | Sample O | 7.6 | 7.8 | >12 | ** |
| Comp. Ex 38 | Sample Q | 7.8 | 8.0 | >12 | ** |
| Comp. Ex 39 | Sample S | 9.5 | 9.6 | >12 | ** |

The above SER results demonstrate the greatly improved shelf life of the coating formulations with minimal impact on the antistatic properties of coated layers for both aqueous and solvent-based coating formulations.

EXAMPLE 40 AND COMPARATIVE EXAMPLE 40

Antistatic coating compositions consisting of silver-doped vanadium pentoxide gels, an aqueous dispersible polyurethane binder and surfactant were prepared according to the formulation given below. Example 40 used PVP intercalated silver-doped vanadium oxide gel (Sample F) and Comparative Example 40 used a silver-doped vanadium oxide gel without PVP (Sample E). The polyurethane binder was Witcobond W-236 commercially available from Witco Corporation.

| Component | Weight percent (wet) |
|---|---|
| $V_2O_5$-gel Sample E or F | 0.033 |
| W-236 Polyurethane binder | 0.133 |
| Triton X-100 | 0.033 |
| Water | balance |

The appearance and viscosity (centipoise) of the coating formulations evaluated immediately after preparation and for aging up to 48 hrs. are reported in Table 11. Comparative Example 40 appeared as a clear reddish-brown solution initially but changed to a greenish gelatinous mixture within 24 hrs. This instability was also reported for a similar formulation used in Example 6 of U.S. Pat. No. 5,718,995. Examples 14–16 of U.S. Pat. No. 5,718,995 teach the use of multiple coating formulations which were mixed just prior to the coating hopper to avoid the observed solution instability.

Example 40 remained a clear reddish-brown solution with no significant change in viscosity demonstrating the effectiveness of PVP intercalation in reducing reactivity between colloidal vanadium oxide gel and polyurethane binders. A significant advantage of the present invention is improved solution stability for antistatic coating formulations. Furthermore, due to the dramatically improved solution stability of colloidal vanadium oxide intercalated with a vinyl-containing polymer compared to prior art vanadium pentoxide gels, a simplified coating process (i.e., single dispersion) can be used over the process described for Examples 14–16 of U.S. Pat. No. 5,718,995.

TABLE 11

| Sample | | Coating Formulation Age: 0 hr | 4 hr | 24 hr | 48 hr |
|---|---|---|---|---|---|
| Example 40 | appearance | clear reddish-brown | clear reddish-brown | clear reddish-brown | clear reddish-green |
| | viscosity | 4.2 | 4.0 | 4.3 | 4.4 |
| Comp Ex 40 | appearance | clear reddish-brown | clear green | cloudy green gel | cloudy green gel |
| | viscosity | 3.9 | 3.9 | 25.2 | 24.7 |

EXAMPLES 41–44 AND COMPARATIVE EXAMPLES 41–44

Aqueous antistatic coating compositions consisting of silver-doped vanadium oxide gel Sample G (Examples 41–44) or Sample E (Comparative Examples 41–44), polyurethane binder (Witcobond W-236) and surfactant were prepared at several ratios of binder to vanadium oxide as indicated below. The solutions were coated on moving 4 mil (100 $\mu$m) thick polyethylene naphthalate support using a coating hopper to give a nominal wet coverage of 0.18 g/m$^2$ for Examples 41–43 and Comparative Examples 41–43 or 0.30 g/m$^2$ for Example 44 and Comparative Example 44. The polyethylene naphthalate support had been previously glow discharge treated in an oxygen-containing atmosphere.

| Component | Weight percent (wet): Comp. 41a | Ex. 41 Comp. 41b | Ex. 42 Comp. 42 | Ex. 43 Comp. 43 | Ex. 44 Comp. 44 |
|---|---|---|---|---|---|
| Sample E or G | 0.033 | 0.033 | 0.033 | 0.033 | 0.010 |
| W-236 | 0.033 | 0.133 | 0.267 | 0.400 | 0.230 |
| Triton X-100 | 0.033 | 0.033 | 0.033 | 0.033 | 0.009 |
| Water | balance | balance | balance | balance | balance |
| binder/$V_2O_5$ | 1/1 | 4/1 | 8/1 | 12/1 | 23/1 |

The conductive layers were overcoated with a transparent magnetic recording layer as described in *Research Disclosure*, Item 34390, November, 1992. The particular transparent magnetic recording layer employed contains cobalt surface-modified $\gamma$-$Fe_2O_3$ particles in a polymeric binder which optionally may be crosslinked and optionally may contain suitable abrasive particles. The polymeric binder consists of a blend of cellulose diacetate and cellulose triacetate. The binder was not crosslinked in the present examples. The magnetic recording layer was applied so as to provide a nominal total dry coverage of 1.5 g/m$^2$. An optional lubricant-containing topcoat layer comprising carnauba wax and a fluorinated surfactant as a wetting aid may be applied over the transparent magnetic recording layer to provide a nominal dry coverage of about 0.02 g/m$^2$. The resultant multilayer structure comprising an electrically-conductive antistatic layer overcoated with a transparent magnetic recording layer, an optional lubricant layer, and other additional optional layers is referred to herein as a "magnetic backing package."

The electrical performance of the magnetic backing package was evaluated by measuring the internal electrical resistivity of the conductive layer using a salt bridge wet electrode resistivity (WER) measurement technique (as described, for example, in "Resistivity Measurements on Buried Conductive Layers" by R. A. Elder, pages 251–254, 1990 *EOS/ESD Symposium Proceedings*). Typically, conductive layers with WER values greater than about 12 log ohms/square are considered to be ineffective at providing static protection for photographic imaging elements. WER values less than about 10 log ohms/square are preferred and less than about 9 log ohm/sq. are more preferred. Dry adhesion of the magnetic backing package was evaluated by scribing a small cross-hatched region into the coating with a razor blade. A piece of high-tack adhesive tape was placed over the scribed region and quickly removed. The relative amount of coating removed is a qualitative measure of dry adhesion. WER and adhesion results are given in Table 12.

TABLE 12

| Sample | binder/$V_2O_5$ | WER log Ω/sq. | dry adhesion |
|---|---|---|---|
| Comp Ex 41a | 1/1 | 7.7 | very poor |
| Comp Ex 41b | 4/1 | 6.8 | fair |
| Comp Ex 42 | 8/1 | * | * |
| Comp Ex 43 | 12/1 | * | * |
| Comp Ex 44 | 23/1 | * | * |
| Example 41 | 4/1 | 6.7 | excellent |
| Example 42 | 8/1 | 6.9 | excellent |
| Example 43 | 12/1 | 7.3 | excellent |
| Example 44 | 23/1 | 7.7 | excellent |

* Could not coat due to viscosity increase and filter plugging

Comparative Example 41a demonstrates very poor adhesion for a binder/vanadium oxide gel weight ratio of 1/1. As expected, increasing the binder/vanadium oxide ratio improves adhesion of the magnetic backing package. However, solution stability for prior art vanadium oxide gels was insufficient for coatability at increased W-236/$V_2O_5$ weight ratios. The viscosity increase and gelation indicated in Comparative Example 40 resulted in filter plugging during coating, consequently formulations with binder/vanadium oxide ratios preferred for improved adhesion could not be prepared. Vanadium pentoxide gels intercalated with polyvinylpyrrolidone, demonstrated excellent solution stability which enabled coating formulations to be prepared at greater binder/vanadium pentoxide ratios. Consequently magnetic backing packages having improved adhesion could be prepared without the use of a mixed melt process as indicated in U.S. Pat. No. 5,718,995 or the use of an additional adhesion promoting layer as taught in U.S. Pat. No. 5,726,001.

EXAMPLES 45 AND COMPARATIVE EXAMPLES 45

Antistatic coating formulations were prepared in a similar manner to Example 41 and Comparative Example 41b. The solutions were coated on moving 4 mil (100 μm) thick polyethylene naphthalate support using a coating hopper to give a nominal wet coverage of 0.18 g/m$^2$. The polyethylene naphthalate support had been previously glow discharge treated in an oxygen-containing atmosphere. The coatings (a–d) were prepared, respectively, from coating formulations which were fresh and aged for 24, 48 and 72 hours prior to coating. The antistatic layers were overcoated with a transparent magnetic recording layer as in Examples 41–44. Total optical (ortho) and ultraviolet densities ($D_{min}$) were evaluated at 530 nm and 380 nm, respectively, using a X-Rite Model 36 IT transmission densitometer. Net or Delta $D_{min}$ values were determined by correcting the total $D_{min}$ values for the contribution from the support. WER values, dry adhesion, UV $D_{min}$ and ortho $D_{min}$ results are given in Table 13.

TABLE 13

| Sample | solution age | WER. log Ω/sq | dry adhesion | UV $D_{min}$ | ortho $D_{min}$ |
|---|---|---|---|---|---|
| Example 45a | fresh | 6.8 | excellent | 0.640 | 0.114 |
| Example 45b | 24 hrs | 6.8 | excellent | 0.640 | 0.116 |
| Example 45c | 48 hrs | 6.9 | excellent | 0.643 | 0.116 |
| Example 45d | 72 hrs | 7.1 | excellent | 0.640 | 0.115 |
| Comp Ex 45a | fresh | 6.7 | excellent | — | — |
| Comp Ex 45b | 24 hrs | 7.3 | excellent | — | — |
| Comp Ex 45c | 48 hrs | * | * | * | * |
| Comp Ex 45d | 72 hrs | * | * | * | * |

— not measured
* did not coat due to poor solution stability

EXAMPLES 46–53 AND COMPARATIVE EXAMPLES 46–53

Antistatic coating formulations were prepared using vanadium oxide gel sample F (Examples) or E (Comparative Examples), a surfactant, and polyvinyl acetate-ethylene emulsions commercially available from Air Products and Chemicals under the tradenames Airflex 426 (Examples 46–48), Airflex 460 (Examples 49–51), Airflex 420 (Examples 52), and Airflex 421 (Examples 53) at the concentrations indicated below. The coating formulations were applied to a moving 4 mil (100 μm) thick polyethylene terephthalate support using a coating hopper to give nominal dry coverages of 0.01, 0.02, and 0.03 g/m$^2$. The polyethylene terephthalate support had been previously coated with a typical primer layer consisting of a terpolymer of acrylonitrile, vinylidene chloride, and acrylic acid. The antistatic layers were overcoated with a transparent magnetic recording layer. SER values were obtained for the antistatic layers prior to overcoating with a magnetic recording layer. SER, WER, adhesion and net ultraviolet and optical densities for the magnetic backing packages are given in Table 14. Comparative Examples 46–53 using vanadium oxide gel sample E, without intercalated PVP were not sufficiently stable and consequently were not coated.

| Component | Weight percent (wet) |
|---|---|
| $V_2O_5$- gel Sample F | 0.033 |
| Binder | 0.133 |
| Triton X-100 | 0.033 |
| Water | balance |

TABLE 14

| Sample | binder | dry covg. g/m$^2$ | SER log Ω/sq. | WER log Ω/sq. | dry adh. | ΔUV $D_{min}$ | Δortho $D_{min}$ |
|---|---|---|---|---|---|---|---|
| Example 46 | Airflex 426 | 0.01 | 8.8 | 9.7 | excellent | 0.183 | 0.061 |
| Example 47 | Airflex 426 | 0.02 | 8.7 | 8.6 | excellent | 0.187 | 0.061 |
| Example 48 | Airflex 426 | 0.03 | 8.8 | 8.7 | excellent | 0.190 | 0.061 |
| Example 49 | Airflex 460 | 0.01 | 9.4 | 9.7 | excellent | 0.179 | 0.061 |
| Example 50 | Airflex 460 | 0.02 | 8.4 | 8.9 | excellent | 0.192 | 0.061 |
| Example 51 | Airflex 460 | 0.03 | 9.1 | 8.7 | excellent | 0.194 | 0.063 |
| Example 52 | Airflex 420 | 0.01 | 8.5 | 8.2 | excellent | 0.178 | 0.060 |
| Example 53 | Airflex 421 | 0.01 | 8.7 | 8.3 | excellent | 0.174 | 0.060 |
| Comp. Ex. 46 | Airflex 426 | 0.01 | * | * | * | * | * |
| Comp. Ex. 47 | Airflex 426 | 0.02 | * | * | * | * | * |
| Comp. Ex. 48 | Airflex 426 | 0.03 | * | * | * | * | * |
| Comp. Ex. 49 | Airflex 460 | 0.01 | * | * | * | * | * |
| Comp. Ex. 50 | Airflex 460 | 0.02 | * | * | * | * | * |
| Comp. Ex. 51 | Airflex 460 | 0.03 | * | * | * | * | * |
| Comp. Ex. 52 | Airflex 420 | 0.01 | * | * | * | * | * |
| Comp. Ex. 53 | Airflex 421 | 0.01 | * | * | * | * | * |

* did not coat due to poor solution stability

EXAMPLE 54

An antistatic coating formulation was prepared using vanadium oxide gel sample F, a surfactant, and a terpolymer latex consisting of n-butylmethacrylate, styrene and methacrlyloyloxyethyl—sulfonic acid at the concentrations indicated below. The coating formulation was applied to a moving 4 mil (100 μm) thick polyethylene terephthalate support using a coating hopper to give nominal dry coverages of 0.01 and 0.02 g/m$^2$. The polyethylene terephthalate support had been previously coated with a typical primer layer consisting of a terpolymer of acrylonitrile, vinylidene chloride, and acrylic acid. The antistatic layer was overcoated with a transparent magnetic recording layer. SER values were obtained for the antistatic layers prior to overcoating with a magnetic recording layer. SER, WER, adhesion and net ultraviolet and optical densities for the magnetic backing packages are given in Table 15.

| Component | Weight percent (wet) |
|---|---|
| $V_2O_5$- gel Sample F | 0.033 |
| Binder | 0.033 |
| Triton X-100 | 0.033 |
| Water | balance |

TABLE 15

| Sample | dry covg g/m$^2$ | SER log Ω/sq. | WER log Ω/sq. | dry adh. | Δ UV $D_{min}$ | Δ ortho $D_{min}$ |
|---|---|---|---|---|---|---|
| Ex. 54a | 0.01 | 9.5 | 8.3 | excellent | 0.199 | 0.069 |
| Ex. 54b | 0.02 | 7.9 | 7.4 | excellent | 0.222 | 0.068 |

The above examples demonstrate the improved solution stability of vanadium oxide gels intercalated with a water soluble vinyl-containing polymer relative to prior art vanadium oxide gels. The improved solution stability facilitates increased binder/vanadium oxide ratios which can improve adhesion of transparent magnetic recording layers, most particularly cellulosic-based magnetic recording layers. The improved stability or reduced reactivity also allows formulation with additional polymeric binders which are useful for providing adhesion for a magnetics backing package but are not compatible with prior art vanadium oxide gels.

The above described supports with electrically-conductive and magnetic recording layers may be coated with imaging layers, such as photographic silver halide emulsion imaging layers as well known in the art, in order to obtain an imaging element in accordance with the invention. As described above, the imaging layer(s) may be coated on the same side of the support as the electrically conductive layer, or on the opposite side, and the imaging elements may contain additional conventional imaging element layers above, below, or between such imaging layers and electrically-conductive layers.

The invention has been described in detail with particular reference to certain preferred embodiments thereof, but it will be understood that variations and modifications can be effected within the spirit and scope of the invention.

What is claimed is:

1. An imaging element comprising: (i) a support; (ii) at least one image forming layer; (iii) a transparent magnetic recording layer comprising magnetic particles dispersed in a first film-forming binder; and (iv) an electrically-conductive layer comprising colloidal vanadium oxide intercalated with a water soluble vinyl-containing polymer dispersed in a second film-forming binder.

2. The imaging element of claim 1, wherein the dry weight ratio of colloidal vanadium oxide to the second film-forming binder is from 4:1 to 1:500.

3. The imaging element of claim 1, wherein the dry weight ratio of colloidal vanadium oxide to the second film-forming binder is from 2:1 to 1:250.

4. The imaging element of claim 1, wherein the electrically-conductive layer comprises a dry weight coverage of from 2 to 1500 mg/m$^2$.

5. The imaging element of claim 1, wherein the electrically-conductive layer comprises a dry weight coverage of from 5 to 500 mg/m$^2$.

6. The imaging element of claim 1, wherein the electrically-conductive layer has a surface resistivity of less than $1\times10^{10}$ ohms per square.

7. The imaging element of claim 1, wherein the colloidal vanadium oxide contains from 0.1 to 20 mole percent of a compound selected from the group containing Ca, Mg, Mo, W, Zn, and Ag.

8. The imaging element of claim 7, wherein the colloidal vanadium oxide contains from 0.1 to 20 mole percent silver.

9. The imaging element of claim 1, wherein the water soluble vinyl-containing polymer is selected from the group consisting of poly-N-vinylpyrrolidone, polyvinylpyrrolidone interpolymers, polyvinylpyrrolidone-polyvinylacetate, polyvinyl alcohol, polyvinyl alcohol interpolymers, polyvinyl alcohol-ethylene, and polyvinyl methyl ether.

10. The imaging element of claim 9, wherein the water soluble vinyl-containing polymer comprises poly-N-vinylpyrrolidone, polyvinyl alcohol or an interpolymer thereof.

11. The imaging element of claim 9, wherein the water soluble vinyl-containing polymer comprises poly-N-vinylpyrrolidone or a polyvinylpyrrolidone interpolymer.

12. The imaging element of claim 1, wherein the water soluble vinyl-containing polymer has a molecular weight of from 10,000 to 400,000.

13. The imaging element of claim 1, wherein the molar ratio of the water soluble vinyl-containing polymer to colloidal vanadium oxide is from 1:4 to 20:1.

14. The imaging element of claim 1, wherein the molar ratio of the water soluble vinyl-containing polymer to colloidal vanadium oxide is from 1:2 to 5:1.

15. The imaging element of claim 1, wherein the first film-forming binder comprises cellulose diacetate, cellulose triacetate or a polyurethane.

16. The imaging element of claim 1, wherein the second film-forming binder comprises a polyurethane.

17. The imaging element of claim 16, wherein the second film-forming binder comprises an aliphatic, anionic, polyurethane having an ultimate elongation to break of at least 350 percent.

18. The imaging element of claim 1, wherein said support comprises poly(ethylene terephthalate) film, cellulose acetate film or poly(ethylene naphthalate) film.

19. The imaging element of claim 1, wherein the transparent magnetic recording layer comprises cobalt surface modified γ-iron oxide particles.

20. The imaging element of claim 19, wherein the cobalt surface modified γ-iron oxide particles comprise a dry weight coverage of from 10 $mg/m^2$ to 1000 $mg/m^2$.

21. A photographic film comprising: (i) a support; (ii) a silver halide emulsion layer on a side of said support; (iii) a transparent magnetic recording layer comprising ferromagnetic particles dispersed in a first film-forming polymeric binder on an opposite side of said support; and (iv) an electrically-conductive layer underlying said transparent magnetic recording layer; said electrically-conductive layer comprising colloidal vanadium oxide intercalated with a water soluble vinyl-containing polymer dispersed in a second film-forming binder.

22. The imaging element of claim 21, wherein the weight ratio of the second film-forming binder to colloidal vanadium oxide is at least 4:1.

23. The imaging element of claim 21, wherein the weight ratio of the second film-forming binder to colloidal vanadium oxide is at least 8:1.

* * * * *